United States Patent [19]

Morrissey

[11] 4,278,514

[45] Jul. 14, 1981

[54] BRIGHT PALLADIUM ELECTRODEPOSITION SOLUTION

[75] Inventor: Ronald J. Morrissey, Cranston, R.I.

[73] Assignee: Technic, Inc., Providence, R.I.

[21] Appl. No.: 120,914

[22] Filed: Feb. 12, 1980

[51] Int. Cl.[3] ..... C25D 3/52

[52] U.S. Cl. ..... 204/47

[58] Field of Search ..... 204/47, 43 N, 109; 106/1.28

[56] References Cited

U.S. PATENT DOCUMENTS

| | | | |
|---|---|---|---|
| 1,981,715 | 11/1934 | Atkinson | 204/43 N |

FOREIGN PATENT DOCUMENTS

| | | | |
|---|---|---|---|
| 2244437 | 3/1973 | Fed. Rep. of Germany | 204/43 N |
| 2506467 | 8/1976 | Fed. Rep. of Germany | 204/43 N |
| 254988 | 10/1969 | U.S.S.R. | 204/47 |
| 452626 | 4/1975 | U.S.S.R. | 204/47 |
| 519497 | 9/1976 | U.S.S.R. | 204/43 N |

*Primary Examiner*—G. L. Kaplan

*Attorney, Agent, or Firm*—Ostrolenk, Faber, Gerb & Soffen

[57] ABSTRACT

A palladium electroplating solution contains the palladium in the form of a soluble organopalladium complex of an inorganic palladium salt and an organic polyamine complexing agent. The solution also preferably contains an imide and free complexing agent.

8 Claims, No Drawings

BRIGHT PALLADIUM ELECTRODEPOSITION SOLUTION

BACKGROUND OF THE INVENTION

Numerous formulations for the electrodeposition of palladium have been reviewed by Atkinson in Modern Electroplating, 2d Ed., Lowenheim, Ed., Wiley, N.Y. 1963, Reid in Plating, 52, 531 (1965) and Wise in Palladium: Recovery, Properties and Uses, Academic Press, N.Y., 1968, pp. 97–103. The formulations contain various palladium species and are operable at pH values throughout virtually the entire 0–14 range. Nevertheless, the most commonly employed palladium plating formulations are almost universally based on inorganic ammine complexes of palladium, such as palladosamine chloride, $Pd(NH_3)_4Cl_2$, or palladium diaminodinitrite, $Pd(NH_3)_2(NO_2)_2$, which is more commonly known as palladium P-salt. Plating formulations containing inorganic ammine palladium complexes are ordinarily operated at pH values between about 8 and 10, and ordinarily contain a slight excess of ammonium hydroxide in the electrolyte in order to stabilize the palladium ions in solution.

The operation of palladium plating formulations containing ammonium ions at alkaline pH incurs several disadvantages. These disadvantages include:

(a) fumes of ammonia are evolved from the plating bath during operation, necessitating adequate ventilation for operator safety, (b) frequent replenishment of ammonium hydroxide is necessary for stability and pH control, and (c) it is well-known in the art that metals such as nickel and copper and the alloys thereof are rapidly tarnished by alkaline ammoniacal solutions and, therefore, in order to plate such materials with palladium from a plating formulation as described above, it is ordinarily necessary to employ a strike coating of gold or silver to protect the surface of the work prior to introduction into the palladium plating bath.

Accordingly, it is an object of this invention to provide a formulation for the electrodeposition of palladium deposits having the usually desired characteristics of brightness, lustre, ductility, evenness of distribution, freedom from stress, high current efficiency, etc., which formulation is free of added ammonium ion so as to be applicable for plating palladium deposits onto substrates including nickel, copper, and alloys thereof, without requiring the application of a strike coating prior to palladium plating. This and other objects of the invention will become apparent to those skilled in this art from the following detailed description.

SUMMARY OF THE INVENTION

This invention relates to palladium coating baths and the use thereof, and more particularly to baths employing palladium complexed with an organic polyamine. The use of imide and organic polyamine brightener are also a subject of the invention.

DESCRIPTION OF THE INVENTION

It has been found that certain organic ligands can be reacted with simple inorganic salts of palladium such as the sulfate, nitrate, halides (chloride, bromide, iodide), etc., to yield soluble organopalladium complexes which are stable in aqueous solution, and which can be discharged by means of an electric current to produce deposits of metallic palladium with high current efficiency at solution pH values from approximately 3 to 7, i.e., in the range from neutral to moderately acid. In general, it is not advisable to electrodeposit palladium under very strongly acid conditions because it is difficult under such conditions to avoid cogeneration of large amounts of hydrogen which can permeate the crystal lattice of palladium and lead to very high deposit stresses. Ligands which are useful for the purposes of this invention are aliphatic and cycloaliphatic polyamines containing 2 to about 8 carbon atoms and 2 to about 5 amino groups. The aliphatic polyamines are preferably of the formula $$H_2N-(CH_2CH_2NH)_x-(CH_2)_y-CH_2CH_2NH_2$$

where x is 0–3 and y is 0–4. The cycloaliphatic polyamines are preferably of the formula

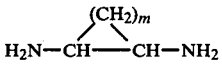

where m is 3–4. Thus, among diamines, effective ligands include ethylenediamine; 1,2-propylenediamine; 1,3-propanediamine; 1,4-butanediamine; pentamethylenediamine; hexamethylenediamine; cyclopentanediamine; and cyclohexanediamine. Among polyamines having more than two amino groups, effective ligands include diethylenetriamine, triethylenetetramine, and tetraethylenepentamine.

The complexes are prepared by simply mixing the inorganic palladium salt and the organic polyamine. If desired, this can be accomplished by adding the organic polyamine to a palladium containing plating bath which is preferably free of ammonia and inorganic ammines. The amount of organic polyamine is that sufficient to provide at least one amino functional group per palladium atom. Since divalent palladium ordinarily exhibits a coordination number of four, the soluble organopalladium complexes of this invention are preferably prepared using a molar ratio of two moles of the polyamine complexing agent per gram atomic weight of palladium. The amount of the complex can be about 1–180 grams per liter and is preferably about 30–90 grams per liter. The other constituents of the plating solution can be the conventional constituents.

It has been further found that in an aqueous electroplating solution of pH from about 3 to 7 containing palladium in the form of a soluble organopalladium complex described above, together with a supporting electrolyte such as phosphate, citrate, malate, etc., as commonly employed in the art for the purpose of providing electrical conductivity and/or pH control for the said solution, a substantial brightening effect is produced by the addition to the solution of an organic imide of the formula

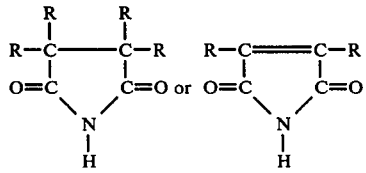

wherein each substituent R, independently, can be hydrogen, alkyl or alkoxy; the alkyl and alkoxy groups not exceeding 5 carbon atoms in size. Typical of these imides are succinimide; 2-methyl succinimide, 2,2,3,4 tetramethyl succinimide; maleimide; and the like.

The concentration of organic imide required to achieve a brightening effect is not critical, and may be varied from about 1 to about 50 grams per liter of electroplating solution.

It has further been found that in an aqueous electroplating solution of pH from about 3 to 7 such as has been described above, containing palladium in the form of a soluble organopalladium complex together with a suitable supporting electrolyte and an added organic imide as hereinabove described, a further improvement in the brightness and appearance of the electrodeposited palladium can be obtained by including in the electroplating solution a quantity of the organic polyamine ligand beyond that forming a part of the soluble organopalladium complex. In order to simplify the chemical makeup of the electroplating solution it is convenient, but not absolutely necessary, to employ as the organic polyamine the same chemical species used as a ligand to form the particular organopalladium complex in solution. For example, in an electroplating solution as hereinabove described in which palladium is present as an ethylenediamine complex, it is convenient to add a quantity of free ethylenediamine to the solution for the purpose of improving the brightness of the electrodeposit, although 1,2-propylenediamine, for example, will produce a similar effect. The quantity of organic polyamine which is effective for brightening purposes of this invention may vary considerably depending on the chemical nature of the additive and the composition of the electroplating solution, but in general will be in the range from about 1–50 grams of polyamine additive per liter of electroplating solution.

In order to illustrate the present invention, some examples are given below:

EXAMPLE 1

Sufficient water was employed to form one liter of a palladium electroplating solution containing the following:

8 grams palladium in the form of palladium bis (ethylenediamine) sulfate
120 grams monopotassium phosphate
15 grams succinimide The solution pH was adjusted to 6.0 by adding potassium hydroxide. A test panel was plated in this solution in a Hull cell for two minutes at 1 ampere at 50° C. A deposit of palladium was obtained which was mirror-bright and haze free at current densities from near zero to about 20 mA/cm$^2$.

EXAMPLE 2

To one liter of the palladium electroplating solution of Example 1 was added 3.6 grams of ethylenediamine. The pH of the solution was readjusted to 6.0 with phosphoric acid. A test panel was plated in this solution in a Hull cell for two minutes at 1 ampere at 50° C. A mirror-bright and haze free deposit of palladium was obtained at current densities from near zero to about 40 mA/cm$^2$.

EXAMPLE 3

An electroplating solution was formed as in Example 1, except that in place of succinimide, maleimide was employed at a concentration of 7.5 grams per liter. The solution pH was adjusted to 4.0 with phosphoric acid. A test panel was plated in this solution in a Hull cell for two minutes at 1 ampere at 25° C. A bright deposit of palladium was obtained at current densities from near zero to about 40 mA/cm$^2$.

EXAMPLE 4

An electroplating solution was formed as in Example 1, except that the palladium employed was in the form of palladium bis (1,2-propylenediamine) sulfate. A test panel was plated in this solution in a Hull cell for 2 minutes at 1 ampere at 50° C. A deposit of palladium was obtained which was mirror-bright and haze free at current densities from near zero to about 15 mA/cm$^2$.

EXAMPLE 5

To one liter of the electroplating solution of Example 4 was added 3.5 grams of 1,2-propylenediamine, and the solution pH was readjusted to 6.0 with phosphoric acid. A test panel was plated in this solution in a Hull cell for two minutes at 1 ampere at 50° C. A deposit of palladium was obtained which was mirror-bright and haze free at current densities from near zero to about 40 mA/cm$^2$.

EXAMPLE 6

An electroplating solution was formed as in Example 1, except that the palladium employed was in the form of palladium bis (1,3-propanediamine) sulfate. The pH of the solution was adjusted to 4.0 with added phosphoric acid. A test panel was plated in this solution in a Hull cell for two minutes at 1 ampere at 50° C. A bright deposit of palladium was obtained at current densities from near zero to about 35 mA/cm$^2$.

EXAMPLE 7

An electroplating solution was formed as in Example 1, except that the palladium employed was in the form of palladium diethylenetriamine sulfate. The solution pH was adjusted to 4.0 with phosphoric acid. A test panel was plated in this solution in a Hull cell for two minutes at 1 ampere at 60° C. A bright deposit of palladium was obtained at current densities from near zero to about 10 mA/cm$^2$.

It will be appreciated by those skilled in the art that various changes and modifications can be made in the present invention without departing from the spirit and scope thereof. The embodiments disclosed herein were for the purpose of illustrating the invention only and were not intended to be limited thereto.

What is claimed is:

1. A palladium electroplating solution of pH of about 3-7 containing palladium in the form of a soluble organopalladium complex of an inorganic palladium salt and an organic polyamine complexing agent having 2 to about 8 carbon atoms and 2 to about 5 amino groups complexing agent; said solution being an aqueous solution; and said solution containing about 1-50 grams per liter of an organic imide of the formula

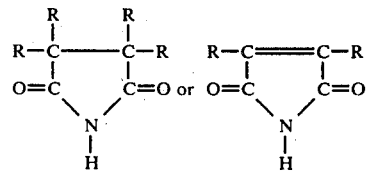

in which each R is independently selected from the group consisting of hydrogen, alkyl of 1–5 carbon atoms and alkoxy of 1–5 carbon atoms.

2. The electroplating solution of claim 1 wherein said organic polyamine is of the formula $$H_2N-(CH_2CH_2NH)_x-(CH_2)_y-CH_2CH_2NH_2 \text{ or}$$

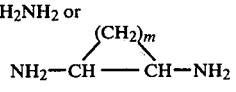

wherein x is 0–3, y is 0–4 and m is 3–4.

3. The electroplating solution of claim 2 wherein the complexing agent for palladium is selected from the group consisting of ethylenediamine, 1,2-propylenediamine, 1,3-propanediamine, 1,4-butanediamine, pentamethylenediamine, hexamethylenediamine, cyclohexanediamine, diethylenetriamine, triethylenetetramine, and tetraethylenepentamine.

4. The electroplating solution of claim 3 wherein said inorganic palladium salt is palladium sulfate.

5. The electroplating solution of claim 1,2,3 or 4 wherein the organic imide is succinimide or maleimide.

6. The electroplating solution of claim 1,2,3 or 4 containing about 1–50 grams per liter of free complexing agent.

7. The electroplating solution of claim 6 wherein the organic imide is succinimide or maleimide.

8. The electroplating solution of claim 7 wherein said free complexing agent is the same chemical species as the complexing agent in said complex.

* * * * *